US009816319B2

(12) United States Patent
Hickie

(10) Patent No.: US 9,816,319 B2
(45) Date of Patent: Nov. 14, 2017

(54) SLANT DRILL RIG TONG CART

(71) Applicant: Nabors Drilling Canada Limited, Calgary, Alberta (CA)

(72) Inventor: Richard Hickie, Red Deer (CA)

(73) Assignee: C&J Energy Production Services-Canada Ltd., Houston, TX (US)

( * ) Notice: Subject to any disclaimer, the term of this patent is extended or adjusted under 35 U.S.C. 154(b) by 273 days.

(21) Appl. No.: 14/668,773

(22) Filed: Mar. 25, 2015

(65) Prior Publication Data

US 2015/0275596 A1 Oct. 1, 2015

Related U.S. Application Data

(60) Provisional application No. 61/971,447, filed on Mar. 27, 2014.

(51) Int. Cl.

| | |
|---|---|
| ***E21B 7/04*** | (2006.01) |
| ***E21B 15/04*** | (2006.01) |
| ***E21B 19/16*** | (2006.01) |
| ***E21B 7/02*** | (2006.01) |

(52) U.S. Cl.

CPC ..... *E21B 7/02* (2013.01); *E21B 19/165* (2013.01)

(58) Field of Classification Search

CPC . E21B 7/021; E21B 3/045; E21B 7/02; E21B 7/04; E21B 15/003; E21B 15/04; E21B 19/161

See application file for complete search history.

(56) References Cited

U.S. PATENT DOCUMENTS

| | | | | |
|---|---|---|---|---|
| 3,280,920 | A * | 10/1966 | Scott | E21B 19/155 173/164 |
| 3,500,708 | A * | 3/1970 | Wilson | E21B 19/163 81/57.34 |
| 4,547,109 | A * | 10/1985 | Young | E21B 15/04 175/85 |
| 2013/0340572 | A1 * | 12/2013 | Flusche | E21B 15/00 81/57.4 |

* cited by examiner

*Primary Examiner* — Cathleen Hutchins

(57) ABSTRACT

A drill rig tong cart is disclosed. The tong cart can include a base portion configured to interface with a drill rig. In addition, the tong cart can include a tong carriage supported by the base portion and configured to interface with a tong for coupling and uncoupling tubulars. The tong carriage can be movable relative to the base portion to alternately position the tong in an engaged position and a disengaged position relative to the tubulars.

21 Claims, 5 Drawing Sheets

SLANT DRILL RIG TONG CART

RELATED APPLICATION

This application claims the benefit of U.S. Provisional Application No. 61/971,447, filed Mar. 27, 2014, which is incorporated herein by reference in its entirety.

BACKGROUND

Many wells, such as oil and/or gas wells are drilled vertically into the earth's crust. However, it is frequently beneficial to drill wells at an angle from vertical. Such "deviated" wells are often drilled from a single surface location towards one or more subsurface targets which are situated some lateral distance away from the surface location. In many cases, such deviated wells are intentionally oriented to penetrate one or more subterranean formations at a desired angle from vertical. Specialized slant rigs have been developed for such wells. Unlike standard drilling rigs which typically have fixed vertical derricks, slant rigs have derricks that can be tilted from horizontal to vertical, with angles of about 35 degrees to about 60 degrees from horizontal being typical. As a drilling operation continues, tubular members, commonly referred to as "tubulars," "pipes," or "singles," are connected in an end-to-end manner to form a drill string. Tubulars are commonly about 30 feet in length and have opposing female and male ends. The ends are threaded in a complementary manner so that opposing male and female ends can be joined together. Closed face power tongs are typically used on slant rigs to "make" and "break" these connections on slant rigs. To prepare a well for production, a production string can be formed in a similar manner using tubulars or pipes, with completion tools attached at the end of the production string. Closed face power tongs are also typically used on slant rigs to thread tools on or off a drill or production string.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
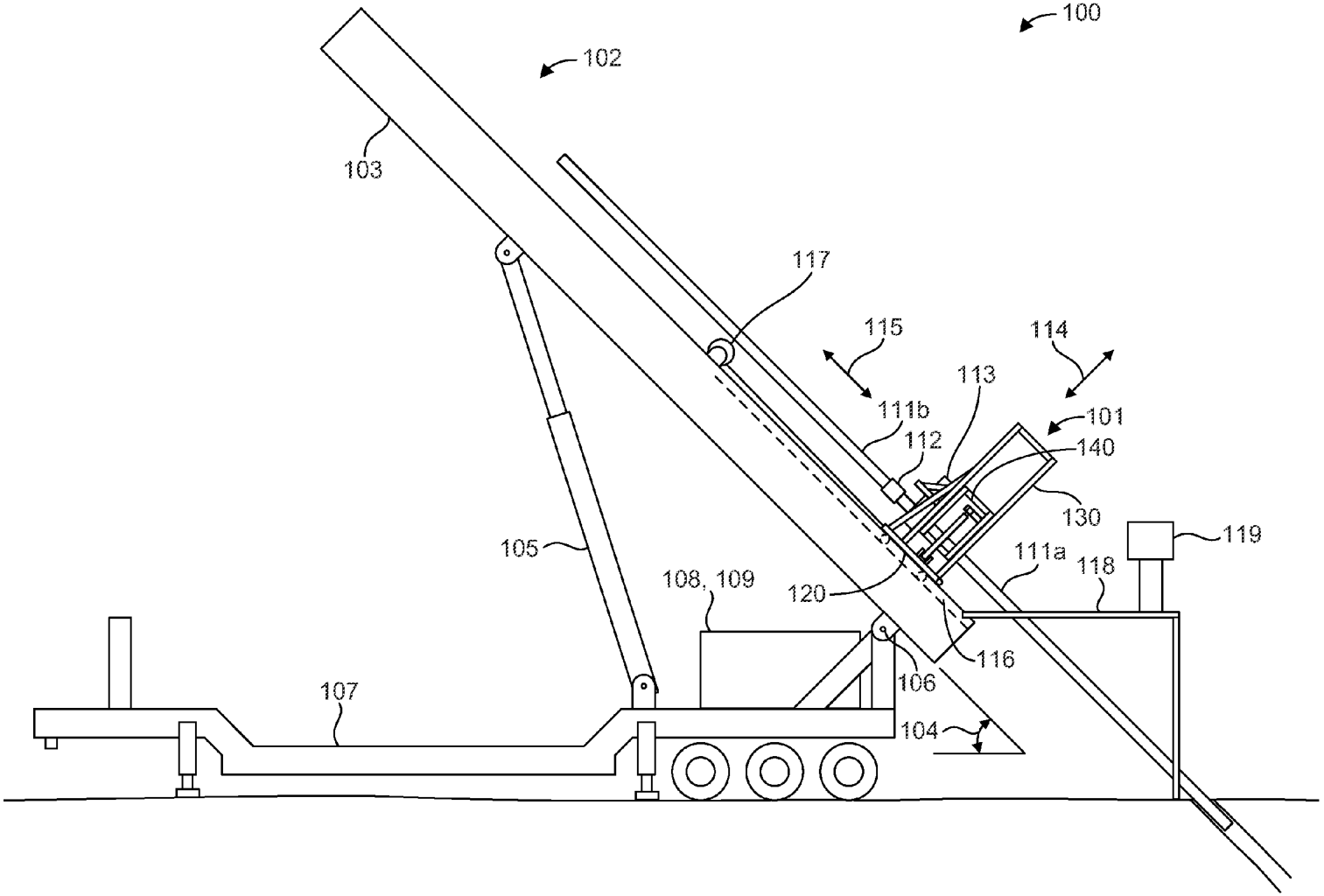
FIG. 1 is an illustration of a drill rig system in accordance with an example of the present disclosure.

Reference will now be made to the exemplary embodiments illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

An initial overview of technology embodiments is provided below and then specific technology embodiments are described in further detail later. This initial summary is intended to aid readers in understanding the technology more quickly but is not intended to identify key features or essential features of the technology nor is it intended to limit the scope of the claimed subject matter.

Although closed face power tongs used on slant rigs are effective for making and breaking tubular and/or tool connections, closed face power tongs are limited in the ability to engage and/or disengage a tubular string, for example, to provide clearance for a tool to pass. Open-face power tongs can engage and/or disengage a tubular string, however, open-face tongs are not typically used on slant rigs, and tong carts for closed face power tongs are not configured to move the tongs in a manner that will engage/disengage a tubular string.

Accordingly, a slant drill rig tong cart is disclosed that facilitates moving an open-face tong between an engaged position and a disengaged position relative to a tubular string. In one aspect, the slant drill rig tong cart can be transformed into a transport configuration to reduce an overall height of the tong cart to comply with public road height requirements when transporting a slant drill rig. The tong cart can include a base portion configured to interface with a drill rig. In addition, the tong cart can include a tong carriage supported by the base portion and configured to interface with a tong for coupling and uncoupling tubulars. The tong carriage can be movable relative to the base portion to alternately position the tong in an engaged position and a disengaged position relative to the tubulars.

A drill rig system is also disclosed. The system can include a slant drill rig and a tong cart supported about the slant drill rig. The tong cart can have a base portion configured to interface with the drill rig, and a tong carriage supported by the base portion. In addition, the system can include an open face tong configured to couple and uncouple tubulars. The tong can be coupled to the tong carriage. The tong carriage can be movable relative to the base portion to alternately position the tong in an engaged position and a disengaged position relative to the tubulars.

One embodiment of a drill rig system 100 is illustrated in FIG. 1. In general, the drill rig system 100 comprises a slant rig 102 to facilitate drilling deviated wells at an angle from vertical. Unlike standard drilling rigs which typically have fixed vertical derricks, the slant rig 102 has a derrick 103 that can be tilted from vertical. The slant rig 102 may be capable of tilting from horizontal to vertical, with an angle 104 of about 35 degrees to about 60 degrees from horizontal being typical.

The slant rig 102 can be skid, track, truck, or trailer-mounted for transportation to and from well sites using standard trucks. The slant rig 102 can therefore be quickly mobilized at a desired drilling location, and thereafter demobilized upon completion of operations. During transportation of the slant rig 102, the derrick 103 is frequently in a collapsed or horizontal position. A hydraulic cylinder 105 or other lift device or system can be used to lift the derrick 103 and thereby tilt the derrick 103 about a pivot 106 on a trailer 107. More specifically, the hydraulic cylinder 105 can be extended or collapsed to position the derrick 103 at a desired angle 104 between 0 and 90 degrees, that is, between horizontal and vertical orientation. A hydraulic pump 108 can be powered by a motor 109 and mounted on the trailer 107 to provide power to the components of the drill rig system 100. The slant rig 102 can therefore include tanks, pumps, motors, and control equipment for the drilling equipment and systems.

Oil field tubular members 111*a*, 111*b*, e.g. drill pipe and casing, are typically employed in sections that are joined together at their ends by threaded connections 112. Therefore an open-face power tong 113 can be utilized to make and break these threaded connections by securely gripping one tubular member and rotatably driving that member relative to the adjoining member. The tong 113 can be supported by a tong cart 101, which can be supported about the slant rig 102, such as by being mounted to the derrick 103.

The tong cart 101 can have a base portion 120 configured to interface with the slant rig 102 and a tong carriage 140 supported by the base portion 120. In one aspect, the tong carriage 140 can be movable in direction 114 relative to the base portion 120 to alternately position the open-face tong 113 in an engaged position and a disengaged position relative to the tubulars 111*a*, 111*b*. For example, the tong carriage 140 can be configured to move substantially perpendicular relative to the slant rig 102 to move the tong 113 between the engaged and disengaged positions. In a particular aspect, the tong cart 101 can include an extension portion 130 supported about the base portion 120. In this case, the tong carriage 140 can be movably coupled to the extension portion 130 to alternately position the open-face tong 113 in the engaged position and the disengaged position relative to the tubulars.

In one aspect, the tong cart 101 can be movable in direction 115 relative to the slant rig 102, such as by being slidably mounted to a track 116 on the derrick 103. Thus, the base portion 120 can be configured to move substantially parallel relative to the slant rig 102. A winch 117 can also be used to raise and lower the tong cart 101 about the derrick 103. As described in more detail below, the tong cart 101 can be configured to be suspended in the track 116 at a desired position. Both the tong carriage 140 and the winch 117 can be hydraulically operated, although any suitable means may be employed, such as electric motors, pneumatic cylinders, etc. Due to the possible angles of the slant drill rig 102, the tong cart 101 can be operable when the slant drill rig 102 is at an angle 104 up to and including about 90 degrees from horizontal.

A work platform 118 can also be mounted near the base of the derrick 103. The work platform 118 can provide a substantially horizontal work deck or rig floor which can be used during drilling operations. The work platform 118 can be adjustable and set in a horizontal orientation regardless of the angle 104 of the derrick 103. A user control interface 119 can be located on the work platform 118 to facilitate remote control of the tong 113, tong cart 101, winch 117, etc. from the work platform 118. In addition, the tong 113 can have a torque monitoring system including, for example, a load cell, to prevent over or under torqueing the tubulars. Using various sensors or other monitoring devices and/or systems (e.g., gauges), as well as various recording systems, torque values can be recorded and printed out to document the torque values applied to each tubular connection.

Figure 2A:
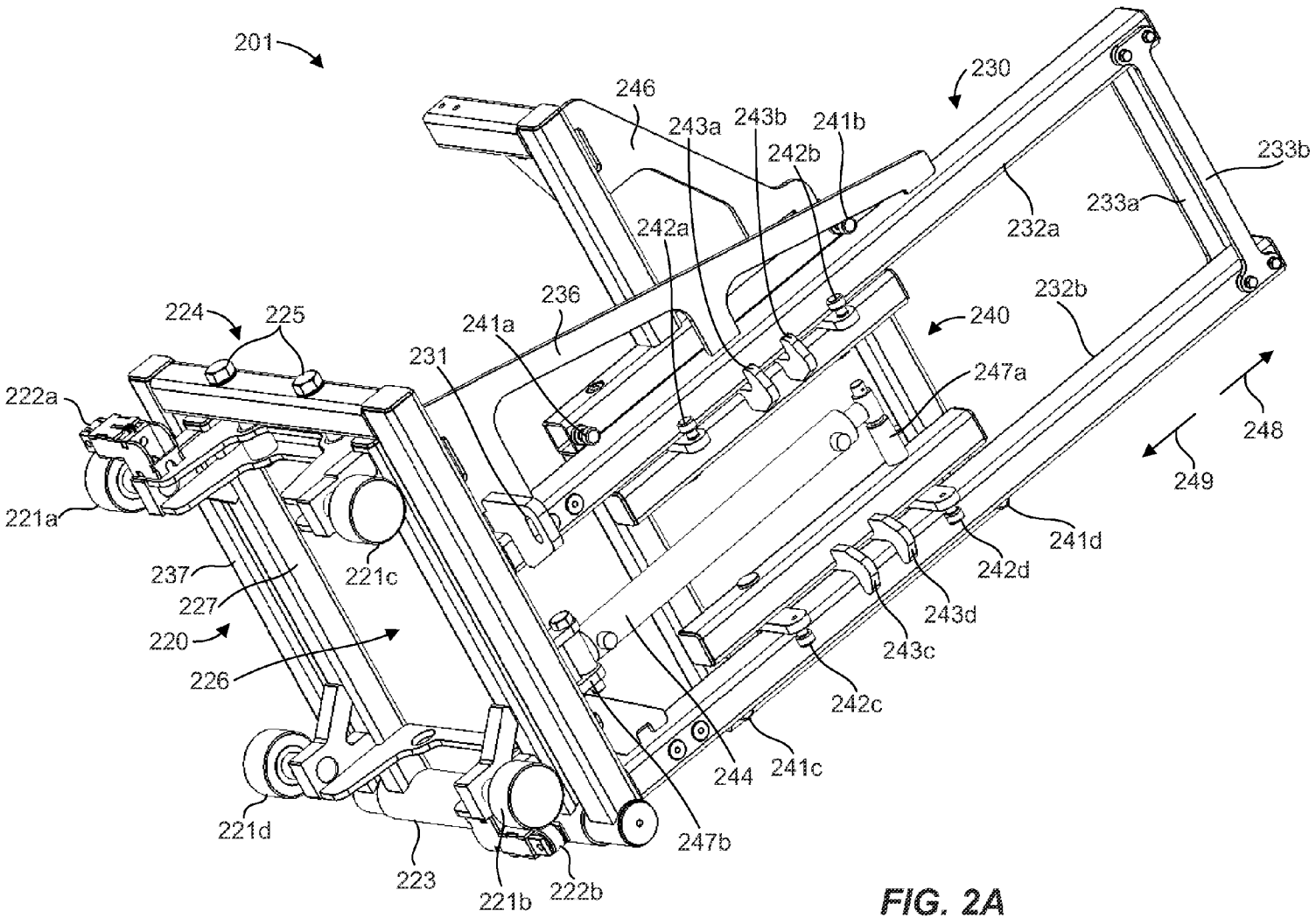
FIGS. 2A and 2B are illustrations of a slant rig tong cart in accordance with an example of the present disclosure.
Figure 2B:
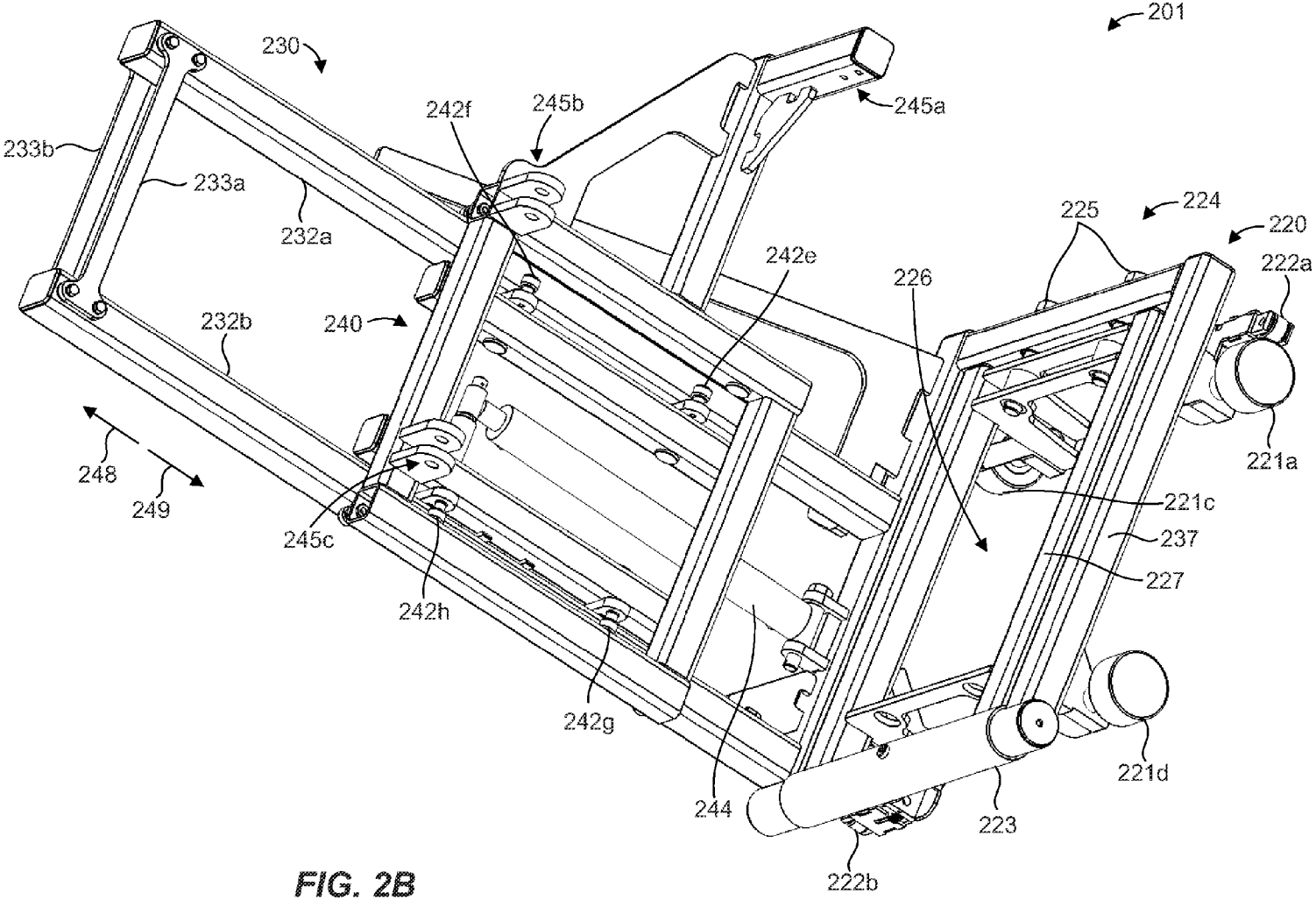

FIGS. 2A and 2B illustrate detailed views of a slant rig tong cart 201, in accordance with an example of the present disclosure, which slant rig tong cart 201 is similar to the one described above, and shown in FIG. 1. In one aspect, a base portion 220 of the tong cart 201 can have one or more wheels and/or rollers (e.g., see rollers 221*a-d*) configured to interface with a track of a slant drill rig or derrick (e.g., see the track and slant drill rig of FIG. 1) to facilitate movement of the base portion 220 relative to the slant rig. In a particular aspect, the base portion 220 can comprise one or more additional wheels and/or rollers 222*a*, 222*b*, which can be laterally movable to engage the track, and which can facilitate free movement of the rollers 221*a-d* in the track and prevent binding. A coupling feature 231 can facilitate coupling with a winch to move the tong cart 201 about the slant rig and derrick. The coupling feature 231 is shown attached to an extension portion 230, which extends from, and is coupled to, the base portion 220. However, it should be recognized that the coupling feature 231 can be attached to the base portion 220.

The extension portion 230 can include extension members 232*a*, 232*b* to provide a guide and support for a tong carriage 240. In one aspect, the tong carriage 240 can include one or more wheels and/or rollers (e.g., see rollers 241*a-d*) configured to engage extension members 232*a*, 232*b*, and to facilitate movement of the tong carriage 240 relative to the extension members 232*a*, 232*b* of the extension portion 230. The tong carriage 240 can further include one or more wheels and/or rollers (e.g., see rollers 242*a-h*) configured to also engage extension members 232*a*, 232*b*, and to maintain alignment of the tong carriage 240 relative to the extension members 232*a*, 232*b* of the extension portion 230. The axes of rotation of the rollers 241 *a-d* can be parallel to one another, but at a different orientation from the axes of rotation of rollers 242 *a-h*, as shown. Such orientation of the roller axes can provide support in multiple degrees of freedom such that the tong carriage 240 and the extension portion 230 are substantially constrained to relative movement in only a single translational degree of freedom, which facilitates bidirectional movement in directions 248, 249. The tong carriage 240 can further comprise tabs 243*a-d*, which can be configured to provide redundant support for the tong carriage 240 in the event that one or more of the wheels or rollers 241*a-d*, 242*a-d* fails. The tabs 243*a-d* can be configured to slide along the extension members 232*a*, 232*b*, such as in the event of failure of one or more of the wheels or rollers 241*a-d*, 242*a-d*. Thus, the tabs 243*a-d* can comprise a low friction surface component or treatment, such as nylon or polytetrafluoroethylene (PTFE). In one aspect, one or more of the wheels or rollers 241*a-d*, 242*a-d* can be replaced or substituted with a low friction surface component or treatment, such as nylon or PTFE.

Although wheels and rollers are shown as being associated with the tong carriage 240, it should be recognized that wheels and/or rollers can be associated with the extension portion 230, as desired, to engage the tong carriage 240. Thus, in one embodiment, the extension portion 230 can include wheels and/or rollers and the tong carriage 240 can include a member or surface configured to interface with the wheels and/or rollers of the extension portion 230.

An actuator 244, such as a hydraulic cylinder, can be coupled to the tong carriage 240 and the extension portion 230 and/or the base portion 220 (e.g., via coupling features 247*a*, 247*b*), to move the tong carriage 240 relative to the extension portion 230 and/or the base portion 220. In one aspect, the actuator 244 can be sized to provide a desired range of motion for the tong carriage 240, such as by configuring the stroke length of a hydraulic cylinder to be substantially equal to the desired range of motion for the tong carriage 244. The location of the coupling features 247*a*, 247*b* can be configured to locate the tong carriage 240 such that the power tong is in the engaged and disengaged positions relative to the tubulars (as described further hereinafter) at the limits of the range of travel of the tong carriage 240. Thus, the actuator 244 can be coupled to the tong carriage 240 and the extension portion 230 and/or the base portion 220 in any suitable manner to provide a desired range of travel for the tong carriage 240. In another aspect, the hydraulic cylinder 244 can comprise a telescoping cylinder to achieve a desired range of travel for the tong carriage 240 to position an open-face power tong in an engaged position and a disengaged position.

The tong carriage 240 can include mounting features 245*a-c* to facilitate coupling with the power tong. Such mounting features 245*a-c* can be of any suitable type, quantity, and configuration and can be disposed in any suitable location to facilitate coupling with a given power tong. The extension portion 230 and the tong carriage 240 can also include a strut or gusset 236, 246, respectively, to provide the tong cart 201 with additional structural support for the power tong.

The tong carriage 240 can also be configured to be removable from the extension portion 230. For example, a spanner support 233*a*, 233*b* can extend between the extension members 232*a*, 232*b* to maintain the extension members 232*a*, 232*b* in position for guiding and supporting the tong carriage 240. In one aspect, the spanner support 233*a*, 233*b* can be removable to facilitate removal of the tong carriage 240 from the extension portion 230.

In one aspect, the base portion 220 and/or the extension portion 230 can be configured to receive at least a portion of the open-face power tong when the tong is in the engaged position with a tubular. For example, the base portion 220 and/or the extension portion 230 can include an opening 226 that can accommodate an end of the tong when moved into position to engage a tubular. The opening 226 can be defined by a frame 227 of the base portion 220 and/or by a frame 237 of the extension portion 230. The frame 227 of the base portion 220 can also provide support for the wheels and/or rollers 221*a-d*, 222*a-b*. The frame 237 of the extension portion 230 can also provide support for the extension arms 232*a*, 232*b*.

Figure 4:
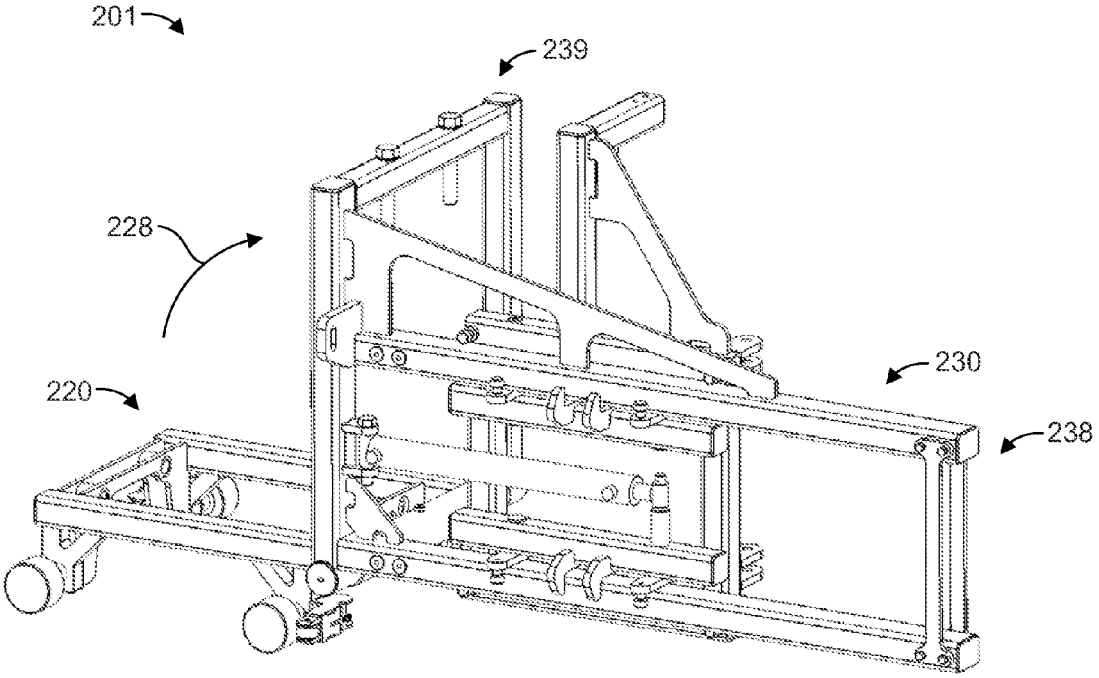
FIG. 4 illustrates the slant rig tong cart of FIGS. 2A and 2B in a transport configuration, in accordance with an example of the present disclosure.

In one aspect, the extension portion 230 can be pivotally coupled to the base portion 220, such as via a pivot or hinge 223, which can facilitate transforming the tong cart 201 between a production configuration (as illustrated in FIGS. 2A and 2B) and a transport configuration (as illustrated in FIG. 4). A locking mechanism 224 can be configured to lock the extension portion 230 relative to the base portion 220 when in the production configuration. The locking mechanism 224 can include a bolt 225, rod, shaft, peg, etc. that extends through openings in the extension portion 230, such as the frame 237, and the base portion 220, such as the frame 227, to prevent the extension portion 230 and the base portion 240 from rotating relative to one another, such as by providing a mechanical interference. Other locking devices and/or systems are contemplated herein, such as those that operate within the hinge 223.

As shown in FIGS. 2A and 2B, the frame 237 of the extension portion 230 is disposed about a perimeter of the frame 227 of the base portion when the tong cart 201 is in the production configuration. This can facilitate locking of the extension portion 230 and the base portion 220 to one another. It should be recognized, however, that the frame 227 of the base portion 220 can be disposed about a perimeter of the frame 237 of the extension portion 230 when the tong cart 201 is in the production configuration. In this case, the frame 227 of the extension portion 230 can define the opening 226 to receive at least a portion of the open-face power tong when the tong is in the engaged position with a tubular.

Figure 3A:
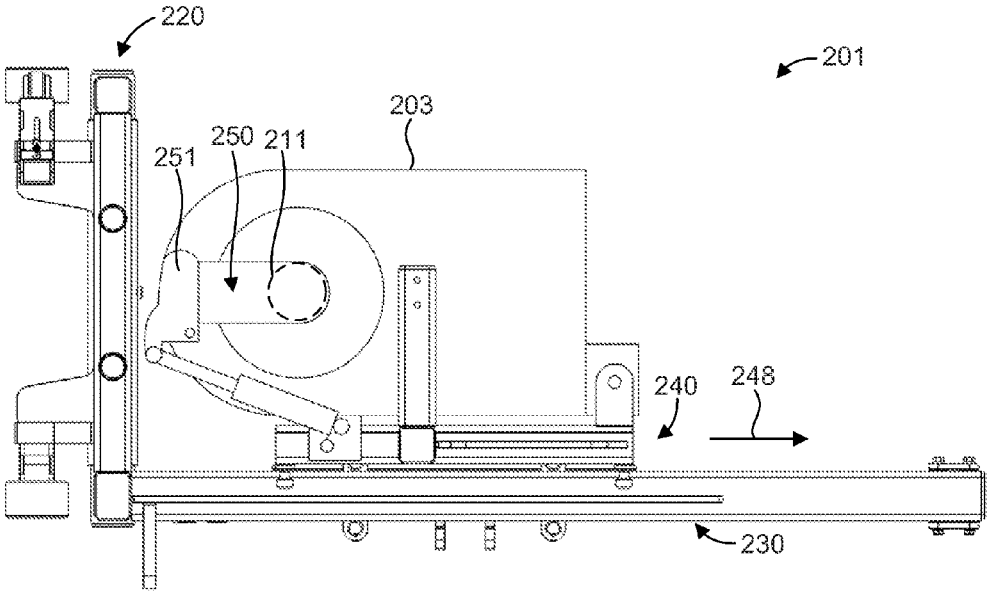
FIG. 3A illustrates the slant rig tong cart of FIGS. 2A and 2B in an engaged position relative to a tubular, in accordance with an example of the present disclosure.
Figure 3B:
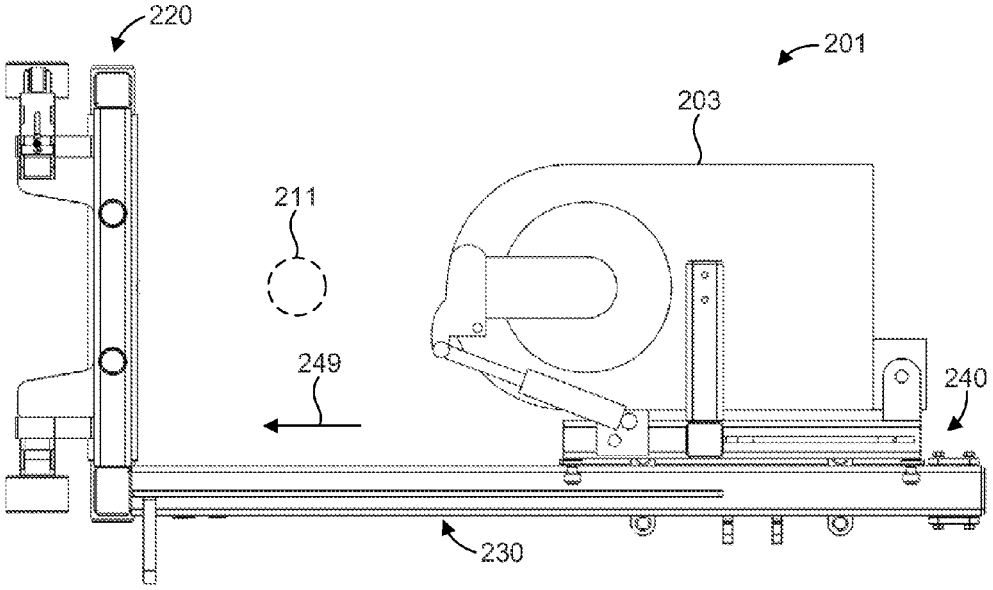
FIG. 3B illustrates the slant rig tong cart of FIGS. 2A and 2B in a disengaged position relative to a tubular, in accordance with an example of the present disclosure.

FIGS. 3A and 3B illustrate the tong cart 201 of FIGS. 2A and 2B moving an open face power tong 203 between an engaged position (FIG. 3A) and a disengaged position (FIG. 3B) relative to a tubular 211. As shown in FIG. 3A, the tubular 211 can extend into a throat 250 of the open-face tong 203. The tong 203 may include a gate 251 over an open end of the throat 250, which can be opened to facilitate removal the open-face tong 203 from the tubular 211 or string. In some cases, the engaged position will locate the tong 203 such that the gate 251 or other portion of the tong 203 will extend into the opening 226, discussed above with regard to FIGS. 2A and 2B. Thus, the opening 226 can be configured to receive the gate 251 when the tong 203 is in the engaged position and/or when the gate 251 opens to facilitate removal of the tong 203 from the tubular 211 or string. Once the tong 203 is free to release the tubular 211 or string, the tong 203 can be moved in direction 248 to a disengaged position from the tubular 211 or string. For example, as shown in the figures, the open face tong 203 is attached to the tong carriage 240, which can move relative to the base portion 220 and the extension portion 230 (e.g., by sliding or rolling along the extension portion 230) in direction 248 from the engaged position to the disengaged position. When desired, the tong 203 can be moved in direction 249 to engage the tubular 211 or string. Thus, the tong cart 201 can facilitate removing the open-face tong 203 from a tubular string at any time to allow tools to pass, to replace tools, and/or to efficiently land dog nuts.

FIG. 4 illustrates the tong cart 201 of FIGS. 2A and 2B in a transport configuration. As discussed above, the extension portion 230 can be pivotally coupled to the base portion 220, which can facilitate conversion or transformation of the tong cart 201 between a production configuration (illustrated in FIGS. 2A and 2B) and the transport configuration shown in FIG. 4. For example, a slant rig can be readied for transport by lowering the derrick to a horizontal configuration, which can result in the tip 238 of the extension portion 230 being the highest point of the slant rig when the tong cart 201 is in the production configuration. In some cases, the height of the tip 238 can otherwise exceed a maximum allowable height allowed for transport on public roads. Pivoting the extension portion 230 relative to the base portion 220 in direction 228 can therefore reduce the overall height of the tong cart 201 by making a side 239 of the extension portion the highest point of the tong cart 201. The tong cart 201 can therefore "fold over" to reduce the overall height of the tong cart 201 and enable the slant drill rig to comply with public road height requirements.

It is noted that the tong carts discussed herein, and shown in the drawings, can comprise a number of different embodiments or designs to adequately engage and support a given power tong, of which there are a number of different designs and configurations. As such, the specific examples discussed herein are not intended to be limiting in any way.

In accordance with one embodiment of the present invention, a method for facilitating use of an open-face power tong on a slant drill rig is disclosed. The method can comprise providing a tong cart having a base portion configured to interface with a slant drill rig, and a tong carriage supported by the base portion and configured to interface with a tong for coupling and uncoupling tubulars. Additionally, the method can comprise facilitating movement of the tong carriage relative to the base portion to alternately position the tong in an engaged position and a disengaged position relative to the tubulars. In one aspect of the method, facilitating movement of the tong carriage relative to the base portion can comprise providing an extension portion supported about the base portion, wherein the tong carriage is movably coupled to the extension portion to alternately position the tong in the engaged position and the disengaged position relative to the tubulars. In another aspect of the method, the tong carriage can comprise at least one of a wheel and a roller to facilitate movement of the tong carriage relative to the extension portion. In one aspect, the method can further comprise providing an actuator to move the tong carriage relative to the base portion. It is noted that no specific order is required in this method, though generally in one embodiment, these method steps can be carried out sequentially.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A slant drill rig tong cart, comprising:

a base portion configured to interface with a slant drill rig;

an extension portion supported about the base portion, wherein the extension portion is rotatable relative to the base portion between a production configuration and a transport configuration; and a tong carriage supported by the extension portion and configured to interface with a tong for coupling and uncoupling tubulars, wherein the tong carriage is movable relative to the extension portion to alternately position the tong in an engaged position and a disengaged position relative to the tubulars.

2. The slant drill rig tong cart of claim 1, wherein the tong carriage is configured to move substantially perpendicular relative to the slant drill rig.

3. The slant drill rig tong cart of claim 1, wherein the tong carriage comprises at least one of a wheel and a roller to facilitate movement of the tong carriage relative to the extension portion.

4. The slant drill rig tong cart of claim 1, wherein the tong carriage comprises at least one of a wheel and a roller to maintain alignment of the tong carriage relative to the extension portion.

5. The slant drill rig tong cart of claim 1, wherein the tong carriage is removable from the extension portion.

6. The slant drill rig tong cart of claim 1, wherein the extension portion is pivotally coupled to the base portion to rotate between the production configuration and the transport configuration.

7. The slant drill rig tong cart of claim 6, further comprising a locking mechanism to lock the extension portion relative to the base portion in the production configuration.

8. The slant drill rig tong cart of claim 1, further comprising an actuator operable to move the tong carriage relative to the extension portion.

9. The slant drill rig tong cart of claim 8, wherein the actuator is coupled to the extension portion and the tong carriage.

10. The slant drill rig tong cart of claim 1, wherein the base portion comprises at least one of a wheel and a roller configured to interface with a track of the slant drill rig to facilitate movement of the base portion relative to the slant drill rig.

11. The slant drill rig tong cart of claim 10, wherein the at least one of the wheel and the roller is configured to interface with a side of the track.

12. The slant drill rig tong cart of claim 11, wherein the at least one of the wheel and the roller is laterally movable to engage the track.

13. The slant drill rig tong cart of claim 1, wherein the base portion is configured to receive at least a portion of the tong when in the engaged position.

14. A drill rig system, comprising:

a slant drill rig;

a tong cart supported about the slant drill rig, the tong cart having a base portion configured to interface with the slant drill rig, an extension portion supported about the base portion, wherein the extension portion is rotatable relative to the base portion between a production configuration and a transport configuration, and a tong carriage supported by the extension portion; and an open face tong coupled to the tong carriage, the tong being configured to couple and uncouple tubulars, wherein the tong carriage is movable relative to the extension portion to alternately position the tong in an engaged position and a disengaged position relative to the tubulars.

15. The system of claim 14, wherein the base portion is configured to move substantially parallel relative to the slant drill rig.

16. The system of claim 14, wherein the base portion comprises at least one of a wheel and a roller configured to interface with a track of the slant drill rig to facilitate movement of the base portion relative to the slant drill rig.

17. The system of claim 14, wherein the tong cart is operable when the slant drill rig is angled up to and including about 90 degrees from horizontal.

18. The system of claim 14, wherein the extension portion is pivotally coupled to the base portion to rotate between the production configuration and the transport configuration.

19. A method for facilitating use of an open-face power tong on a slant drill rig, comprising:

providing a tong cart having a base portion configured to interface with a slant drill rig, an extension portion supported about the base portion, wherein the extension portion is rotatable relative to the base portion between a production configuration and a transport configuration, and a tong carriage supported by the extension portion and configured to interface with a tong for coupling and uncoupling tubulars; and facilitating movement of the tong carriage relative to the extension portion to alternately position the tong in an engaged position and a disengaged position relative to the tubulars.

20. The method of claim 19, wherein the tong carriage comprises at least one of a wheel and a roller to facilitate movement of the tong carriage relative to the extension portion.

21. The method of claim 19, further comprising providing an actuator to move the tong carriage relative to the extension portion.

* * * * *